US008657068B2

(12) United States Patent
Gassner

(10) Patent No.: US 8,657,068 B2
(45) Date of Patent: Feb. 25, 2014

(54) SECURING DEVICE

(75) Inventor: Stefan Gassner, Missen (DE)

(73) Assignee: EDELRID GmbH & Co. KG, Isny im Allgäu (DE)

( * ) Notice: Subject to any disclaimer, the term of this patent is extended or adjusted under 35 U.S.C. 154(b) by 307 days.

(21) Appl. No.: 12/429,264

(22) Filed: Apr. 24, 2009

(65) Prior Publication Data

US 2009/0200107 A1 Aug. 13, 2009

Related U.S. Application Data

(63) Continuation of application No. PCT/EP2007/061495, filed on Oct. 25, 2007.

(30) Foreign Application Priority Data

Oct. 27, 2006 (DE) ..... 10 2006 051 426
Sep. 12, 2007 (DE) ..... 10 2007 043 422

(51) Int. Cl.
*A62B 35/00* (2006.01)

(52) U.S. Cl.
USPC ..... 182/12; 182/8; 182/36

(58) Field of Classification Search
USPC ..... 182/12, 36, 5, 3, 4, 8, 9, 29, 192; 104/112, 113, 115, 116
See application file for complete search history.

(56) References Cited

U.S. PATENT DOCUMENTS 3,177,543 A * 4/1965 Fountain ..... 188/65.2
4,034,828 A * 7/1977 Rose et al. ..... 182/5
4,423,796 A * 1/1984 Sulowski et al. ..... 182/8
4,560,029 A * 12/1985 Dalmaso ..... 182/5
4,657,110 A * 4/1987 Wolner ..... 182/5
4,846,075 A * 7/1989 Tupper ..... 104/209
5,156,240 A * 10/1992 Ostrobrod ..... 188/65.1

(Continued)

FOREIGN PATENT DOCUMENTS

DE 10 2005 009 946 B3 7/2006
DE 10 2006 010 898 A1 9/2007

(Continued)

OTHER PUBLICATIONS

Machine Translation of foriegn prior art, published Jan. 1, 1994, 1994 , pp. 1-2 (FR2694044, submitted by applicant in French, except for abstrtact on latest IDS).*

*Primary Examiner* — Alvin Chin Shue
*Assistant Examiner* — Colleen M Chavchavadze
(74) *Attorney, Agent, or Firm* — Reinhart Boerner Van Deuren P.C.

(57) ABSTRACT

The present invention relates to a securing device for protecting individuals against falling, with two stop elements which can be attached releasably to a positionally fixed securing element and can be connected via a connecting element to the individual. Each stop element has a locking device which can be adjusted between an unlocking state, in which the stop element can be attached to the securing element or released therefrom, and a locking state, in which the stop element cannot be released from the respective securing element. A coupling device is coupled to the locking devices of the stop elements in such a manner that, in the unlocking state, the locking device of the other stop element is blocked in its locking state. A preferred construction of the coupling device has a blocking lever which can be pivoted into a blocking position for blocking the locking device in its locking state.

25 Claims, 8 Drawing Sheets

(56) References Cited

U.S. PATENT DOCUMENTS

| | | | | | |
|---|---|---|---|---|---|
| 5,265,696 | A * | 11/1993 | Casebolt | 182/8 |
| 5,316,103 | A * | 5/1994 | Bell et al. | 182/18 |
| 5,638,919 | A * | 6/1997 | Pejout | 182/192 |
| 5,855,251 | A * | 1/1999 | Deuer | 182/5 |
| 5,924,522 | A * | 7/1999 | Ostrobrod | 182/191 |
| 6,019,195 | A * | 2/2000 | Pelofi | 182/192 |
| 6,056,086 | A * | 5/2000 | Gortan et al. | 182/197 |
| 6,095,502 | A * | 8/2000 | Dodge, Jr. | 254/389 |
| 6,161,647 | A * | 12/2000 | Braden et al. | 182/8 |
| 6,530,454 | B1 * | 3/2003 | Renton et al. | 182/36 |
| 6,945,357 | B1 * | 9/2005 | Flux | 182/36 |
| 7,007,772 | B2 * | 3/2006 | Argoud | 182/36 |
| 7,080,716 | B2 * | 7/2006 | Cherpitel | 182/192 |
| 2002/0112916 | A1 * | 8/2002 | Ador | 182/5 |
| 2004/0129494 | A1 * | 7/2004 | Cherpitel | 182/5 |
| 2006/0124391 | A1 | 6/2006 | Jones et al. | |
| 2006/0289235 | A1 * | 12/2006 | Chen | 182/192 |
| 2010/0012425 | A1 * | 1/2010 | Gassner | 182/5 |
| 2011/0031065 | A1 | 2/2011 | Strasser | |
| 2011/0047764 | A1 | 3/2011 | Strasser | |

FOREIGN PATENT DOCUMENTS

| | | | | |
|---|---|---|---|---|
| EP | 0363234 | A1 | 4/1990 | |
| EP | 2694044 | A1 | 1/1994 | |
| EP | 1 832 315 | A1 | 9/2007 | |
| FR | 2694044 | A1 | 1/1994 | |
| FR | 2820641 | A1 * | 8/2002 | A62B 35/00 |
| WO | WO 92/07199 | A1 | 4/1992 | |
| WO | WO 2008/049143 | A1 | 5/2008 | |

* cited by examiner

C-C

D-D

B-B

A-A

SECURING DEVICE

CROSS-REFERENCE TO RELATED PATENT APPLICATIONS

This patent application is a Continuation of co-pending PCT Application No. PCT/EP2007/061495, filed Oct. 25, 2007, designating the U.S. and which claims the benefit of German Patent Application No. 10 2006 051 426.2, filed Oct. 27, 2006, and German Patent Application No. 10 2007 043 422.9 filed Sep. 12, 2007, the entire teachings and disclosures of which are incorporated herein by reference thereto.

FIELD OF THE INVENTION

The instant invention relates to a securing device for protecting individuals against falling. The invention furthermore relates to a stop element for such a securing device.

BACKGROUND OF THE INVENTION

A related securing device is fundamentally known from DE 10 2006 010 898 A1 and comprises two stop elements, which in each case can be attached releasably to a positionally fixed securing element and which in each case can be connected via a connecting element to the individual, who is to be secured. Each stop element thereby encompasses a locking device, which can be adjusted between an unlocking state, in which the respective stop element can be attached to the respective securing element or can be released therefrom, and a locking state, in which the respective stop element, which is attached to the respective securing element, cannot be released from the respective securing element in a non-destructive manner. The known securing device furthermore comprises a coupling device, which is coupled to the locking devices of the two stop elements, in fact in such a manner that, in the unlocking state of the locking device of the one stop element, it blocks the locking device of the other stop element in its locking state.

This design of the securing device makes it possible for the danger of falling for the individuals, who are secured therewith, to be reduced significantly. In response to changing from one securing element to another securing element it is necessary to reposition the two stop elements one after the other. The coupling device of the known securing device thereby prevents both stop elements from being inadvertently removed simultaneously from the respective securing element, whereby the individual would be unsecured temporarily.

A securing device, which is made up of a safety harness, which is fastened to the body of the user, two connecting elements, each of which comprises a carabiner via which a displaceable and releasable connection between the safety harness and a supporting cable can be established, as well as an electronic circuit for monitoring the correct securing of the user, is furthermore known from DE 10 2005 009 943 B3. The electronic circuit thereby monitors the hooking of the carabiners to the supporting cable and generates an acoustic warning signal as soon as not at least one of the two carabiners is hooked into the supporting cable. In addition, the known securing device can furthermore be embodied in such a manner that the electronic circuit blocks an opening mechanism of a carabiner via an electromagnetic actuating device as soon as the other carabiner is opened and/or is unhooked from the supporting cable, whereby a simultaneous unhooking of both of the carabiners and thus an inadvertent faulty operation of the securing device by the user is avoided.

BRIEF SUMMARY OF THE INVENTION

The instant invention deals with the problem of specifying an improved embodiment for a securing device of the aforementioned type and for the stop elements used therewith, respectively, which is characterized in particular by an inexpensive feasibility with a comparatively high functional reliability.

This problem is solved according to embodiments of the invention by means of the objects of the independent claims. Advantageous embodiments are the object of the dependent claims.

Embodiments of the invention are based on the general idea to equip the coupling device for at least one of the locking devices with a blocking lever, which interacts with the respective locking device in such a manner that, in a blocking state, it blocks the respective locking device in its locking state. Such a pivotable blocking lever can be realized in a comparatively inexpensive and robust manner, whereby a relatively high functional reliability can be attained.

According to an advantageous embodiment, the corresponding locking device for at least one of the stop elements can encompass a lock, which can be pivoted between a locking position, which is assigned to the locking state of the locking device, and an unlocking position, which is assigned to the unlocking state of the locking device. Additionally or alternatively, the respective locking device for at least one of the stop elements can encompass a securing lever, which can be pivoted between a securing position, which blocks the lock in its locking position and an unlocking position, which makes it possible to pivot the lock between its locking position and its unlocking position. The danger of an inadvertent unlocking of the lock is thus reduced, because the securing lever must initially be actuated for this purpose. An inadvertent simultaneous actuation of the securing lever as well as of the lock can be made virtually impossible. Such a double securing increases the securing effect of the securing device.

In its blocking position, the blocking lever according to the invention can now either interact with the lock, which is adjusted in its locking position or with the securing lever, which is adjusted in its securing position. Likewise, in its blocking position, the respective blocking lever can block the lock in its locking position as well as the securing lever in its securing position. The embodiment, in which the blocking lever, in its blocking position, blocks the corresponding securing lever in its securing position, is thereby preferred. It is considered hereby that only comparatively small forces are required at the securing lever for blocking said securing lever in its closing position. When the securing lever is blocked in the closing position, the lock is inevitably also blocked in its locking position.

According to its development, the coupling device can encompass a power transmission element, via which the blocking levers, which are assigned to the two locking devices, are coupled to one another, in fact in such a manner that a pivoting actuation of the one blocking lever pivots the other blocking lever in its blocking position. Power transmission elements, which are suitable for this, are in particular Bowden cables, where the traction cable and the cable core, respectively, is in each case connected to the two blocking levers, while the corresponding pressurized cover is supported in the area of the respective locking device. Fundamentally, however, other power transmission elements, which operate in a mechanical, hydraulic or pneumatic manner, are also possible.

Provision can now be made in a development for the lock and/or the securing lever within the respective locking device to interact with the blocking lever for its actuation. A pivoting of the securing lever and of the lock, respectively, thus leads to a pivoting actuation of the respective blocking lever. The actuation of the blocking lever by means of the securing lever can thereby be advantageous, because the respectively other blocking lever is thus already pivoted into its blocking position when the lock, which is assigned to the actuated securing lever, has not yet been actuated. In other words, the locking device of the other stop element is already blocked when only the securing lever of the one stop element is actuated.

Further important features and advantages of the invention result from the subclaims, from the drawings and from the corresponding figure description by means of the drawings.

It is understood that the afore-mentioned features and the features, which will still be defined below, can not only be used in the respectively specified combination, but also in other combinations or alone, without leaving the scope of the instant invention.

Other aspects, objectives and advantages of the invention will become more apparent from the following detailed description when taken in conjunction with the accompanying drawings.

BRIEF DESCRIPTION OF THE DRAWINGS

Preferred exemplary embodiments of the invention are illustrated in the drawings and will be defined in more detail in the following description, wherein the same reference numerals refer to equivalent or similar or functionally equivalent components. Schematically.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
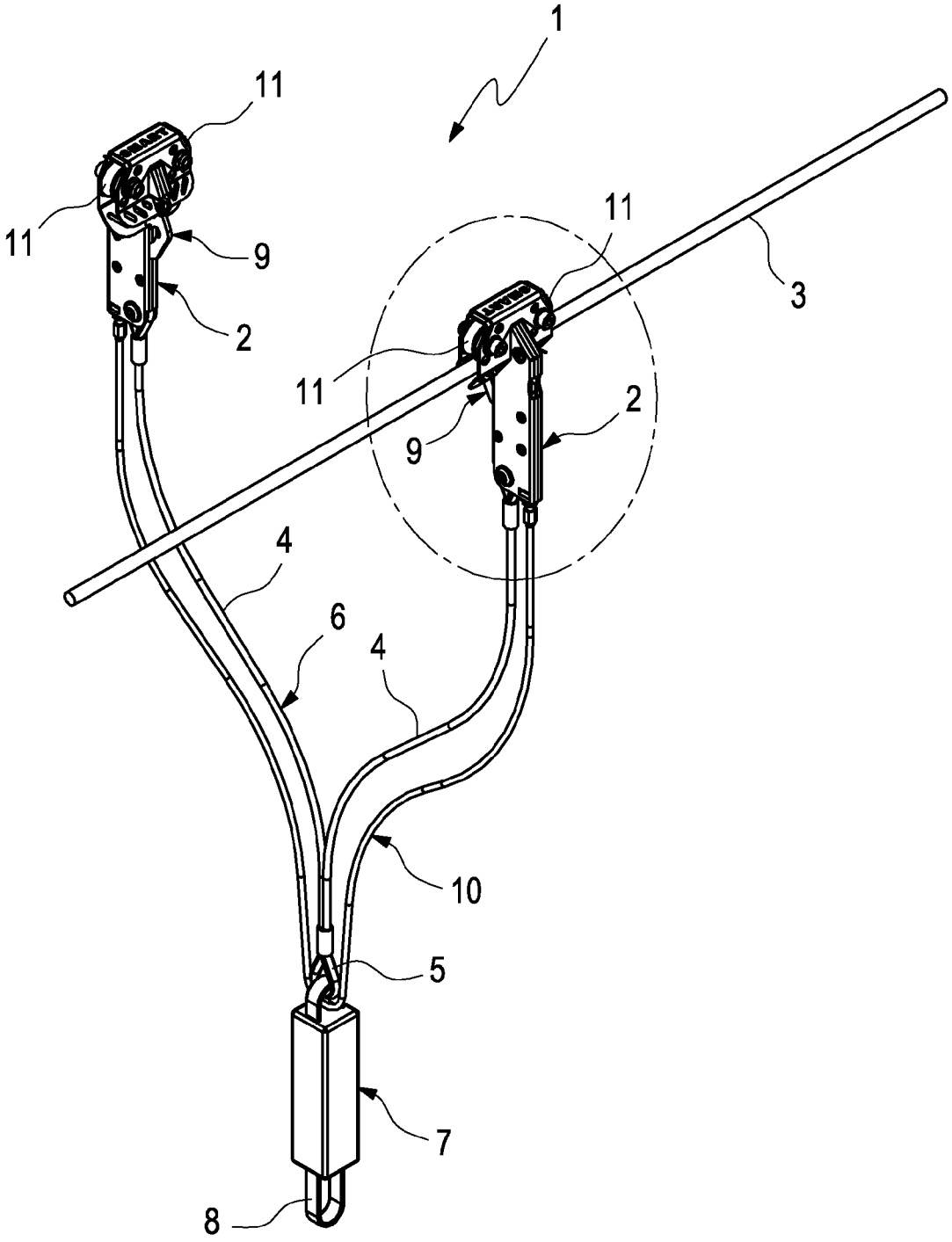
FIG. 1 shows a perspective view of a securing device.
Figure 5:
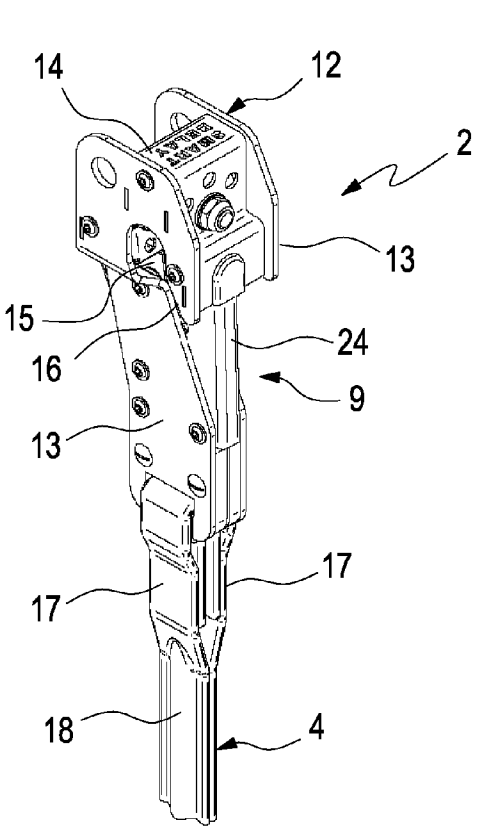
FIG. 5 shows a perspective view of the stop element.
Figure 3:
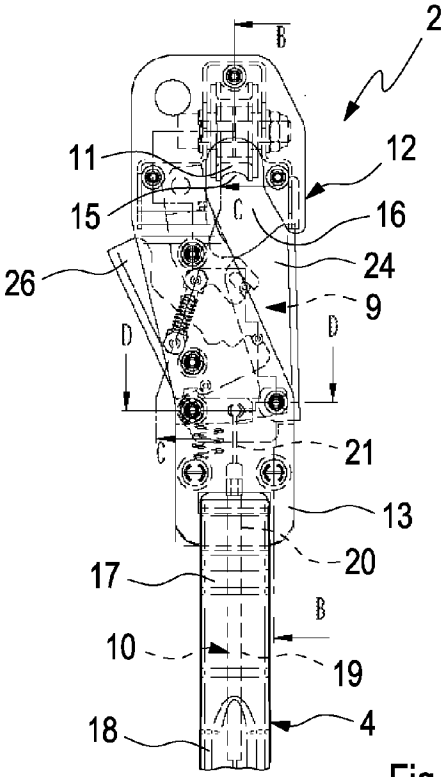
FIG. 3 shows a side view of the stop element.
Figure 4:
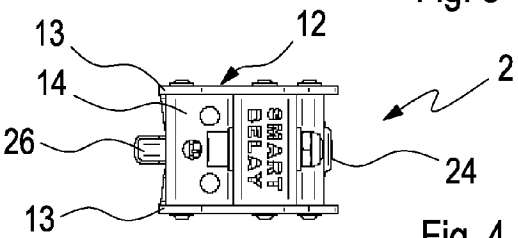
FIG. 4 shows a top view of the stop element.
Figure 2:
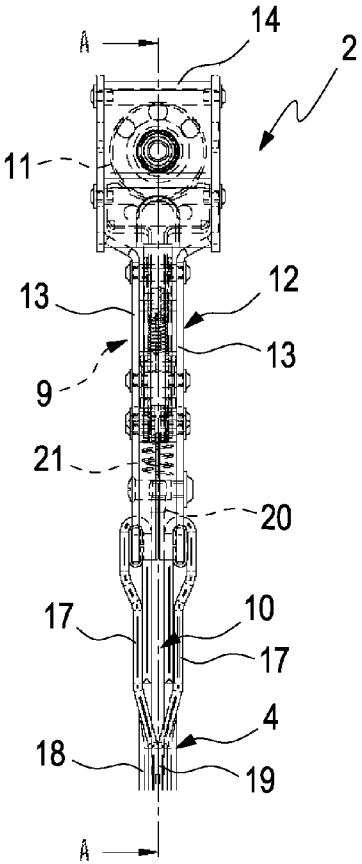
FIG. 2 shows a front view of a stop element.
Figure 8:
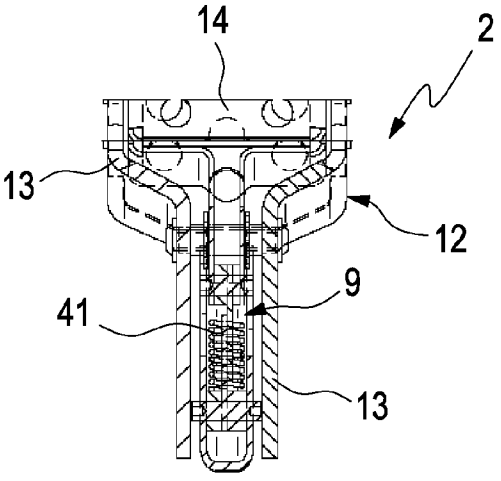
FIG. 8 shows a sectional view according to intersecting lines C-C according to FIG. 3.
Figure 9:
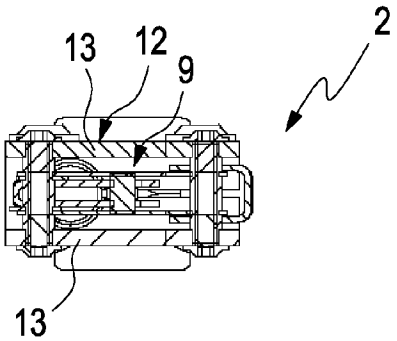
FIG. 9 shows a sectional view according to intersecting lines D-D in FIG. 3.
Figure 7:
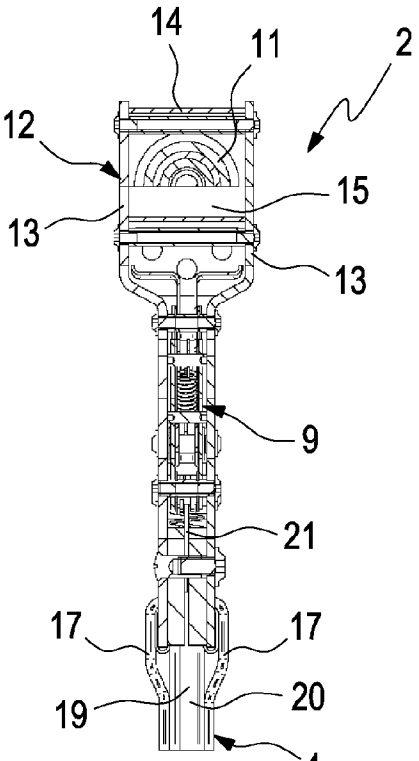
FIG. 7 shows a sectional view according to intersecting lines B-B in FIG. 3.

According to FIG. 1, a securing device 1 according to an embodiment of the invention, which serves the purpose of protecting a non-illustrated individual against falling, comprises two stop elements 2. Each stop element 2 is embodied in such a manner that it can be attached releasably to a positionally fixed securing element 3. In FIG. 1, only the stop element 2, which is illustrated on the right-hand side, is hooked or attached, respectively, to the securing element 3, which is embodied herein as a cable, while the stop element 2, which is illustrated on the left-hand side, is distanced from the securing element 3. Each stop element 2 is furthermore connected in each case to a connecting element 4, wherein the respective connecting element 4 can be connected to the respective individual, who is to be secured. In the embodiment shown in FIG. 1, the connecting element 4 is a cable. In the embodiment of FIGS. 2 to 14, the connecting element 4 is formed by a belt. In the example according to FIG. 1, the two connecting elements 4 form a common loop 5, by means of which they can be attached jointly to the individual, who is to be secured. The two connecting elements 4 thus form a common connecting component 6 herein. Likewise, two completely separate connecting elements 4 can also be used. As a matter of principle, the connecting elements 4 and the connecting component 6, respectively, can be fastened directly to a safety belt of the individual, who is to be secured, via the loop 5 by means of a carabiner or the like. In the instant case, provision is furthermore made for equipment 7 for reducing the impact of a fall, which can belong to the scope of the securing device 1. The connecting elements 4 and the connecting component 6 are or is, respectively, fastened to the equipment 7 for reducing the impact of a fall, which in turn can be fastened to the respective individual by means of a loop 8 and to the safety belt of said individual by means of carabiners, respectively.

It is clear that the connecting elements 4 can also be embodied as chain or the like, for example.

Each stop element 2 encompasses a locking device 9. The respective locking device 9 can be adjusted between an unlocking state and a locking state. In the unlocking state, the respective stop element 2 can be attached to the respective securing element 3 and can be released therefrom, respectively. Contrary thereto, in the locking state, the respective stop element 2 can no longer be released from the respective securing element 3, to which it is attached, in a non-destructive manner.

The securing device 1 presented herein furthermore comprises a coupling device 10. Said coupling device 10 is coupled to the locking devices 9 of the two stop elements 2. This coupling thereby takes place in such a manner that the coupling device 10, in the unlocking state of the locking device 9 of the one stop element 2, blocks the locking device 9 of the other stop element 2 in its locking state. This means that, in response to the unlocking of the one locking device 9 via the coupling device 10, the other locking device 9 is inevitably blocked in its locking state and can then no longer be unlocked. The coupling device 10 preferably operates in a purely mechanical manner, in particular in a hydraulic or pneumatic manner. Fundamentally, a coupling device 10, which operates in an electrical manner, is also possible. However, the embodiments, which operate without auxiliary power, are preferred.

The stop elements 2 shown in FIG. 1 are embodied as casters, which encompass in each case two rollers 11, which are arranged behind one another and by means of which the respective stop element 2 can unroll on the securing element 3, which is embodied as a cable. In the embodiments of FIG. 2 to 14, the respective stop element 2 is also embodied as a caster, which, however, is only equipped with a single roller 11. Embodiments, where the respective stop element 2 is embodied as a carabiner hook, are likewise possible.

The subsequent description of FIGS. 2 to 14 relates to the partial area of the securing device 1, which is enclosed by means of a discontinuous line in FIG. 1. In particular, the design of an individual stop element 2 is defined in more detail. It is clear that both stop elements 2 of the securing device can fundamentally be designed to be constructed in the same manner, but they do not need to be.

According to FIGS. 2 to 5, the respective stop element 2 encompasses a housing 12, which is substantially made up of molded sheet metal parts. Two side cheeks 13, between which a cover 14 is arranged, are visible. The roller 11 is rotatably supported in an upper area of the housing 12, in particular by means of a ball bearing. An accommodation 15 for accommodating the respective securing element 3 is also located in this upper area. To be able to introduce the respective securing element 3 up into the accommodation 15 and to be able to remove the securing element 3 from the accommodation 15 again, the accommodation 15 is equipped with an insertion opening 16. Overall, the housing 12 is designed like a hook by means of the accommodation 15 and the insertion opening 16. An embodiment without roller 11 is likewise possible. The accommodation 15 then forms a support so that the respective stop element 2 overall again forms a hook, in particular a carabiner hook.

The connecting element 4 is fastened in a lower area of the housing 12. In the illustrated example, the connecting element 4 consists of two separate belts 17, each of which are fastened to one of the side cheeks 13 independent on one another. The two belts 17 are sewed together underneath the housing 12, whereby they form a tube 18. In the preferred embodiments shown herein, the coupling device 10 comprises a power transmission element 19, which leads from the locking device 9 of the one stop element 2 to the locking device 9 of the other stop element 2. Here, this power transmission element 19 runs within the tube 18, whereby it is sufficiently protected against damages in the normal use of the securing device 1. Preferably, the power transmission element 19 is a Bowden cable, which typically is made up of a pressure-resistant casing 20 and a traction-stable cable 21, which is guided therein and which can also be characterized as cable core 21.

According to FIGS. 6 to 9 as well as in particular according to FIGS. 10 to 14, the coupling device 10 for the locking device 9 of the respective stop element 2 comprises a blocking lever 22. This blocking lever 22 is pivotably supported on the housing 12 about a blocking lever axis of rotation 23, which stands perpendicularly on the drawing plane in FIGS. 10 to 14. The blocking lever 22 can thereby be pivoted into a blocking position, in which it blocks the respective locking device 9 in its locking state. In the embodiment, which operates with the Bowden cable as power transmission element 19, the cable 21 is fixed to the respective blocking lever 22. The casing 20 is supported on the housing 12.

Figure 6:
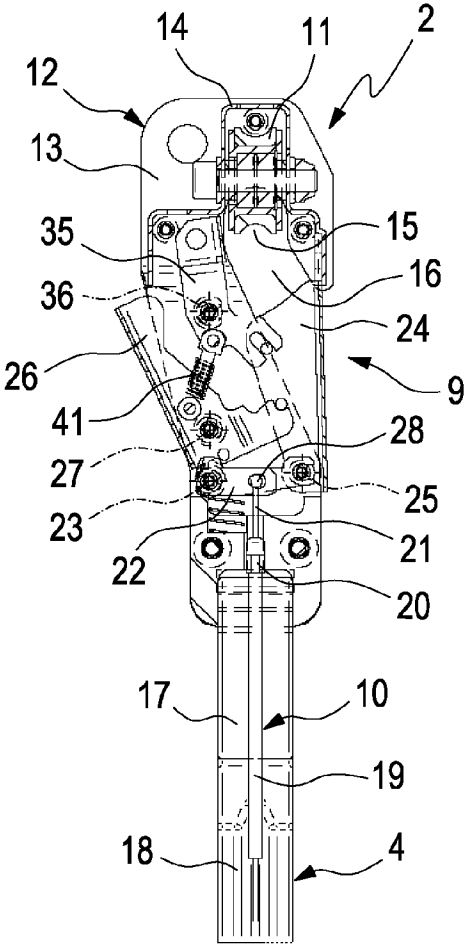
FIG. 6 shows a sectional view according to intersecting line A-A in FIG. 2.
Figure 10:
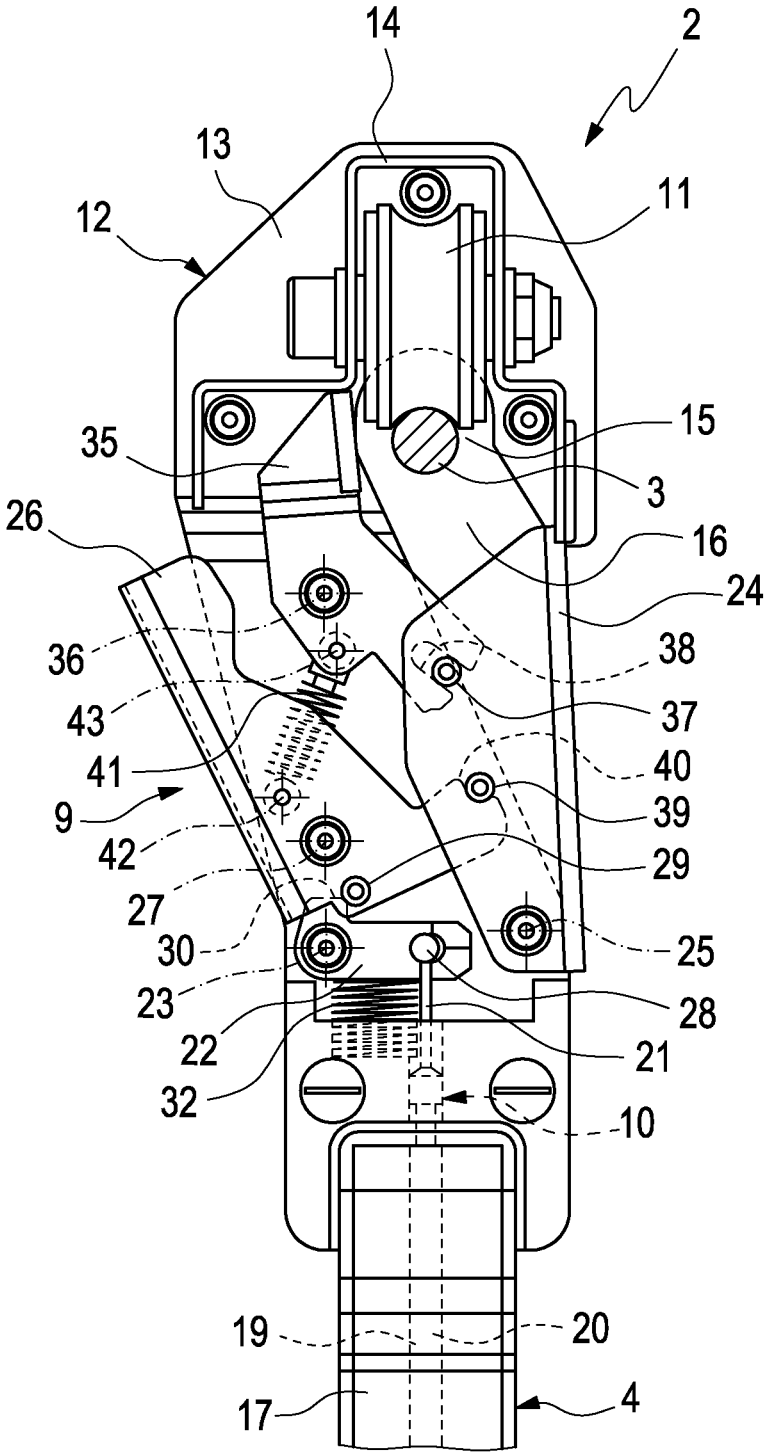
FIGS. 10 to 12 show in each case a sectional view as in FIG. 6 in response to different actuating states.
Figure 11:
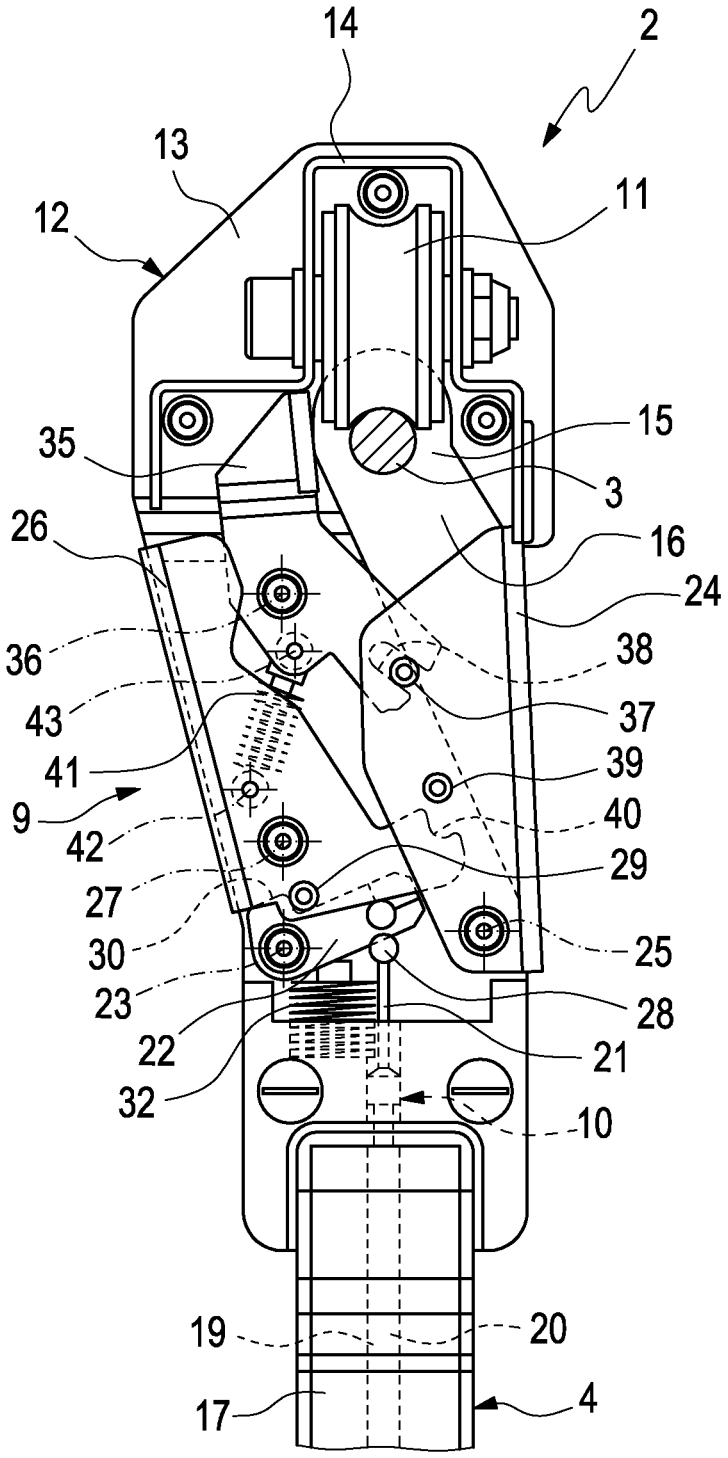

Here, the locking device 9 encompasses a lock 24, which can be pivoted about a lock pivoting axis 25, which runs perpendicular to the drawing plane in FIGS. 10 to 14. The lock 24 can thereby be pivoted between a locking position, which is assigned to the locking state of the locking device 9, and an unlocking position, which is assigned to the unlocking state of the locking device 9. In FIGS. 6, 10 and 11, the lock 24 is in its locking position, while it is in its unlocking position in FIG. 12.

Here, the locking device 9 furthermore comprises a securing lever 26, which can be pivoted about a securing lever pivoting axis 27, which runs perpendicular to the drawing plane in the illustrations of FIGS. 10 to 14. The securing lever 26 can be pivoted between a securing position, in which it blocks the lock 24 in its locking position, and an unlocking position or release position, in which it makes it possible to pivot the lock 24 between its locking position and its unlocking position. To realize this interaction between securing lever 26 and lock 24, a control bolt 39 is embodied herein in an exemplary manner between securing lever 26 and lock 24. Said control bolt 24 interacts with a guide sliding track 40, which is embodied on the securing lever 26.

In the embodiments shown herein, the blocking lever 22 now interacts with the securing lever 26. This means that the blocking lever 22, in its blocking position, blocks the securing lever 26 in its securing position. Due to the fact that, in the securing position of the securing lever 26, the lock 24 is blocked in its locking position by means of the securing lever 26, the corresponding locking device 9 is in its locking state and cannot be removed from the securing element 3.

In the alternative, it is fundamentally also possible to arrange and to embody, respectively, the blocking lever 22 in such a manner that it interacts directly with the lock 24, so that the blocking lever 22, in its blocking position, blocks the lock 24 in its locking position. Likewise, it is also possible to embody and arrange, respectively, the blocking lever 22 in such a manner that it simultaneously interacts with the lock 24 as well as with the securing lever 26.

The force transmission element 19 couples the two blocking levers 22 of the two locking devices 9 with one another in such a manner that a pivoting motion of the one blocking lever 22 pivots the other blocking lever 22 in its blocking position. In the embodiment shown herein, the securing lever 26 is provided for actuating the blocking lever 22. Here, the securing lever 26 interacts accordingly with the corresponding blocking lever 22 in a suitable manner. A pivoting of the securing lever 26 into its unlocking position thus leads to a pivoting actuation of the blocking lever 22, which pivots the other blocking lever 22 into its blocking position via the power transmission element 19. It is clear that a drive coupling can fundamentally also be provided between the lock 24 and the blocking lever 22. However, the alternative proposed herein, where the actuation of the securing lever 26 already actuates the blocking lever 22, is preferred.

Figure 13:
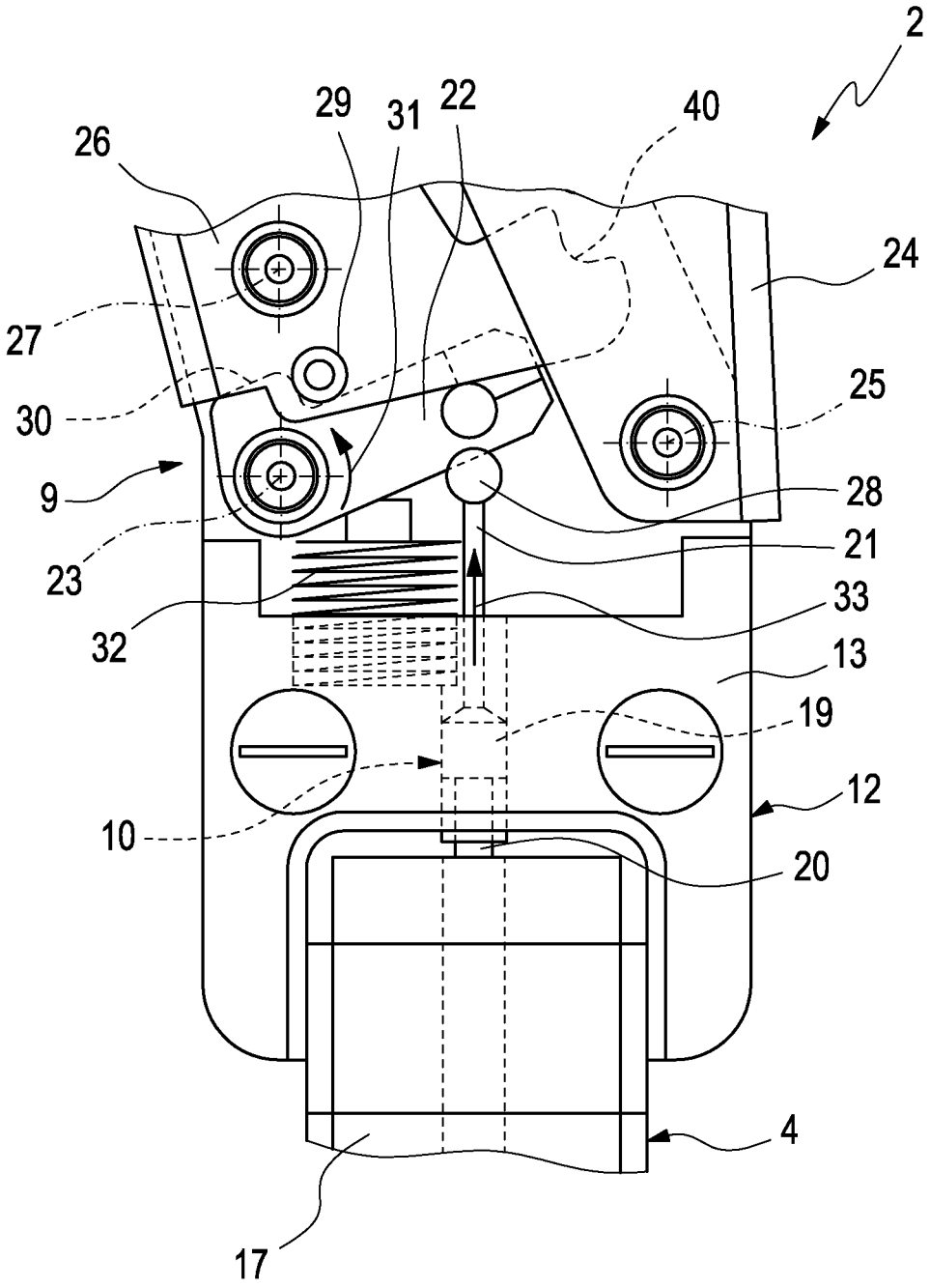
FIGS. 13 and 14 show in each case an enlarged sectional view according to FIG. 6 in the area of a blocking lever in response to different actuating states.
Figure 14:
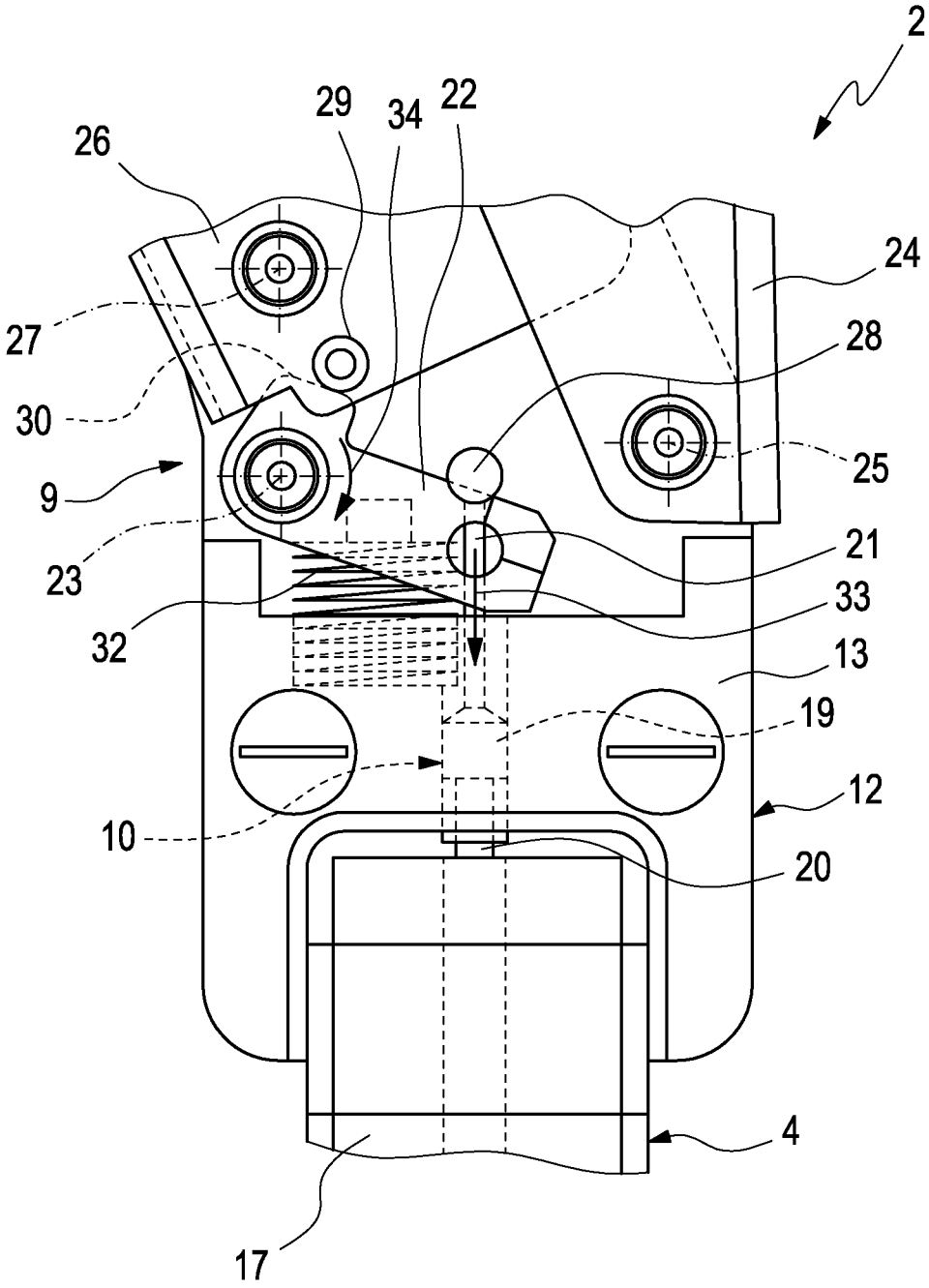

FIGS. 13 and 14 exemplify the different pivoting processes of the blocking lever 22. A connecting link 28, via which the cable 21 of the respective Bowden cable 19 is fixed to the blocking lever 22, is thereby depicted in the relative position, in which this connecting link 28 is located when the blocking lever 22 assumes a rest position. The respective blocking lever 22 assumes its rest position when both locking devices 9 each encompass their locking state.

In FIG. 13, the securing lever 26 is pivoted into its unlocking position. The securing lever 26 encompasses a control bolt 29, which interacts with a guide sliding track 30, which is embodied on the blocking lever 22. The guide sliding track 30 and the control bolt 29 are adjusted to one another in such a manner that, by means of pivoting the securing lever 26 into its unlocking position, the blocking lever 22 is pivoted in such a manner that it introduces a tensile force into the power transmission element 19. In FIG. 13, the pivoting motion takes place in a counter-clockwise manner in a direction of rotation 31, which is signified by means of an arrow. This rotation of the blocking lever 22 can be supported by means of a pressure spring 32. The tensile force, which is introduced into the power transmission element 19 by means of the blocking lever 22, which is pivot-actuated in such a manner, is signified herein by means of an arrow, which is oriented upwards and which is identified with 33.

FIG. 14 shows virtually the other end of the power transmission element 19, which transfers the tensile force 33 onto the blocking lever 22 of the other locking device 9. Accordingly, this tensile force 33 in FIG. 14 is oriented downwards.

Subsequently, the blocking lever 22 pivots in opposite direction of rotation, which is symbolized herein by means of an arrow and which is identified with 34. This other direction of rotation 34 is oriented herein in clockwise direction. Provided that the securing lever 26 assumes its securing position, the control bolts 29 and the guide sliding track 30 also interact herein. The guide sliding track 30 is hereby moved into the adjustment travel of the control bolt 29, whereby said control bolt 29 abuts on the guide sliding track 30 as on a stop. Subsequently, the pivotability of the securing lever 26 is blocked so that said securing lever can no longer be pivoted out of its securing position. The blocking lever 22, for blocking the respective locking device 9 in the one direction of rotation 34, accordingly pivots out of its rest position into its blocking position, while it is pivoted out of its rest position in response to its pivoting actuation in the opposite direction of rotation 31.

Figure 12:
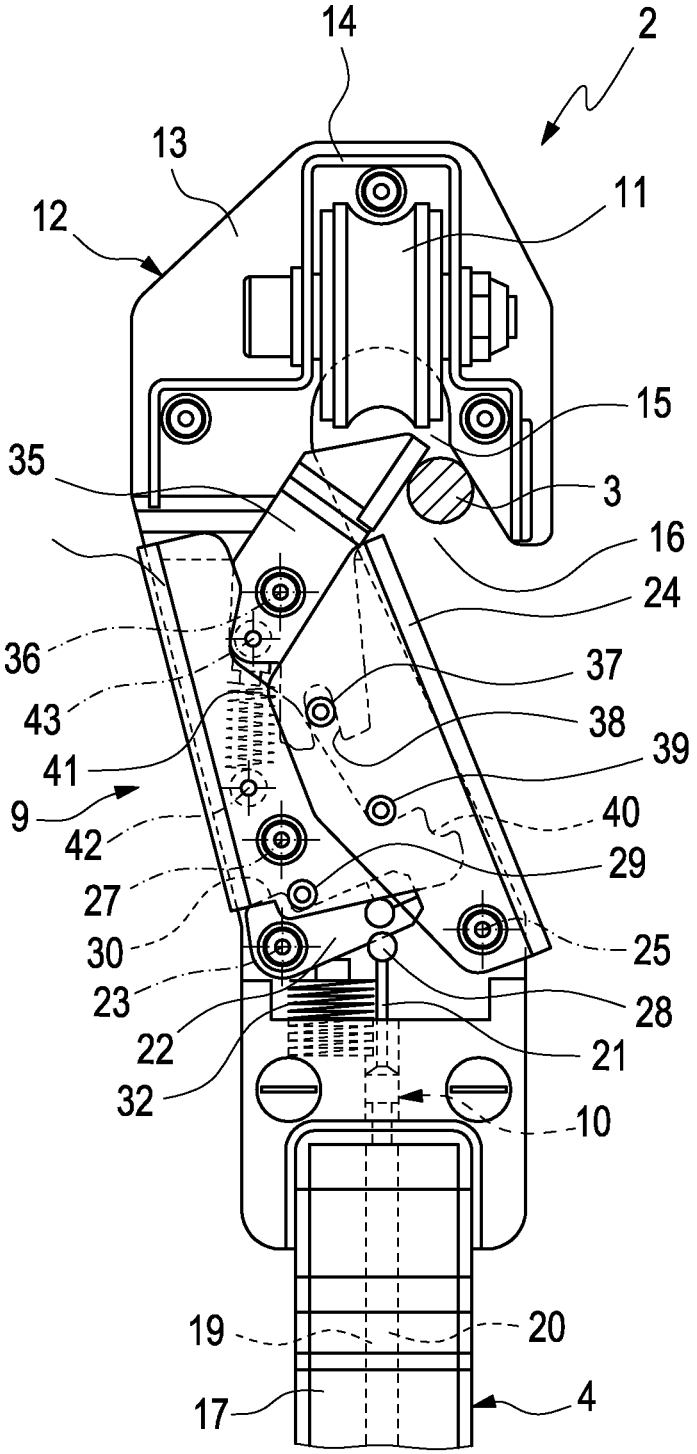

According to FIG. 6 as well as 10 to 12, the respective locking device 9 furthermore comprises a release lever 35, which is supported on the housing 12 in a pivotably adjustable manner about a release lever axis of rotation 36, which stands perpendicularly on the drawing plane in FIGS. 6 and 10 to 12. Said release lever 35 can be pivoted between an active position and a passive position. In the active position, which is depicted in FIG. 12, the release lever 35 blocks the lock 24 in its unlocking position. For this, a control bolt 37, which is embodied at the lock 24, interacts with a guide sliding track 38, which is embodied at the release lever 35. In the illustrated example, the lock 24 encompasses the afore-mentioned additional control bolt 39, which interacts with the further guide sliding track 40, which is embodied at the securing lever 26. This interaction between control bolt 39 and guide sliding track 40 is furthermore designed herein in such a manner that the lock 24, in its unlocking position, blocks the securing lever 26 in its unlocking position. In the end, the release lever 35, which is pivoted into its active position, thus directly blocks the lock 24 in its unlocking position and indirectly blocks the securing lever 26 in its unlocking position via the unlocked lock 24. This state is depicted in FIG. 12.

In the passive position of the release lever 35 depicted in FIGS. 6, 10 and 11, the release lever 35 makes it possible to pivot the lock 24 in its locking position as well as to indirectly pivot the securing lever 26 in its securing position.

In its active position 35, the release lever 35 is positioned in such a manner that it is inevitably transferred into its passive position by attaching the respective stop element 2 to the respective securing element 3. For this, the release lever 35 according to 12, in its active position, projects into the insertion opening 16 to the extent that the securing element 3 is inevitably actuated in response to the insertion of the release lever 35 and thus pivots out of its active position, so as to be able to reach the accommodation 15. The securing element 3 must thus push aside the release lever 35 so as to thus be able to reach the accommodation 15 through the insertion opening 16. This construction causes the lock 24 to inevitably be transferred into its locking position, when attaching the stop element 2 to the securing element 3, while the securing lever 26 is simultaneously also transferred into its securing position. An effective securing of individuals can thus be ensured immediately after the stop element 2 has been attached to the securing element 3.

The release lever 35 is pretensioned into its respective end position by means of a pressure spring actuation 41, that is, either into the active position or into the passive position. Said pressure spring actuation 41 encompasses an over dead center position for the active position as well as for the passive position. On the one hand, the pressure spring actuation 41 is supported on the securing lever 26 at a bearing position, which is identified with 42. On the other hand, the pressure spring actuation 41 is supported on the release lever 35 at a bearing position, which is identified with 43. In the alternative, the pressure spring actuation 41 could also encompass its bearing position 42 on the housing 12, instead of on the securing lever 26.

In the passive position of the release lever 35 shown in FIGS. 10 and 11, the bearing position 43 at the side of the release lever is located to the right of an imaginary line, which extends through the bearing position 42 at the securing lever side and through the axis of rotation of the release lever 36. Contrary thereto, the bearing position 43 at the release lever side in the active position of the release lever 35 shown in FIG. 12 is located to the left of said line, which extends through the bearing position 42 at the securing lever side and through the axis of rotation of the release lever 36. To get from the one position to the other position, the distance between the two bearing positions 42, 43 of the pressure spring actuation 41 must thus be shortened up to the dead center position, in which the two bearing positions 42, 43 and the axis of rotation of the release lever 36 are located on a common line. Accordingly, the two end positions of the release lever 35, thus the active position and the passive position, are stable over dead center positions. To reach from the one position into the other position, said instable dead center position must be overcome. Until then, the release lever 35 must be pivoted against the reset force of the pressure spring actuation 41. When overcoming the dead center position, the pressure spring actuation 41 then automatically actuates the release lever 35 into the respective other position.

In the embodiments shown herein, the lock 24 is embodied as a lock 24, which can be directly actuated manually and which can be actuated by means of index finger and middle finger, for example. At the same time, the securing lever 26 is embodied herein as a securing lever 26, which can be directly actuated manually and which can be actuated by means of a thumb, for example. Securing lever 26 and lock 24 are arranged herein at mutually opposite sides of the respective stop element 2, whereby a one-handed operation is possible.

With reference to FIGS. 10 to 12, an unlocking process and a locking process, respectively, are to be defined briefly in the following. In FIG. 10, the locking device 9 is in the locking state. The lock 24 encompasses its locking position. It can thereby be seen that the lock 24, in its locking position, locks the insertion opening 16 so that it is not possible to remove the stop element 2 from the securing element 3 in a non-destructive manner. The securing lever 26 assumes its securing position. The release lever 35 is in its passive position. The blocking lever 22 is in its rest position. The securing element 3 is located in the accommodation 15. The roller 11 bears in particular on the securing element 3.

According to FIG. 11, the user initially actuates the securing lever 26, so as to pivot it into the unlocking position for the purpose of unlocking. The blocking lever 22 is thereby inevitably actuated, whereby it pivots into the blocking position. According to FIG. 12, the user subsequently actuates the lock 24 and pivots it into the unlocking position. In response to this pivoting process, the release lever 35 is inevitably co-adjusted, because the lock 24 is provided herein for actuating the release lever 35. The release lever 35 hereby pivots through the accommodation 15 in such a manner that it drives the securing element 3 arranged therein out of the accommodation 15. Through this, the release lever 35 supports the removal of the stop element 2 from the securing element 3.

When the stop element 2 is attached to the securing element 3, the securing element 3 now displaces the release lever 35, whereby said release lever 35 automatically snaps into its passive position after overcoming the dead center position. On the one hand, the lock 24 is thereby inevitably actuated in its locking position. On the other hand, the securing lever 26 is thus also released again, whereby it can be pivoted into the securing position. The securing lever 26 can thereby be spring-loaded. The securing lever 26 is actuated herein by means of the pressure spring actuation 41.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A securing device for protecting individuals against falling, comprising:

two stop elements, each stop element can be attached releasably to a positionally fixed securing element and each stop element can be connected via a connecting element to the individual, who is to be secured;

wherein each stop element encompasses a locking device, which can be adjusted between an unlocking state, in which the respective stop element can be attached to the respective securing element or can be released therefrom, and a locking state, in which the respective stop element, which is attached to the respective securing element, cannot be released from the respective securing element in a non-destructive manner;

a coupling device, which is coupled to the locking devices of the two stop elements in such a manner that, in the unlocking state of the locking device of the one stop element, it blocks the locking device of the other stop element in its locking state; and wherein the coupling device encompasses a blocking lever for at least one locking device, said blocking lever being capable of being pivoted into a blocking position for operably blocking the respective locking device in its locking state such that the respective locking device cannot be pivoted from its locking state to its unlocking state in a non-destructive manner, while the other locking device can be still adjusted between both its unlocking state and its locking state.

2. The securing device according to claim 1, wherein the respective locking device encompasses a lock, which can be pivoted between a locking position, which is assigned to the locking state of the locking device, and an unlocking position, which is assigned to the unlocking state of the locking device.

3. The securing device according to claim 2, wherein the respective locking device encompasses a securing lever, which can be pivoted between a securing position, which blocks the lock in its locking position, and an unlocking position, which makes it possible to pivot the lock between its locking position and its unlocking position, the blocking lever operably blocking the respective locking device in its locking state through the securing lever.

4. The securing device according to claim 2, wherein the respective blocking lever, in its blocking position, operably blocks the lock in its locking position such that the lock cannot pivoted from the locking position in a non-destructive manner.

5. The securing device according to claim 4, wherein the coupling device encompasses a power transmission element, via which the blocking levers, which are assigned to the two locking devices, are coupled to one another, in such a manner that a pivoting actuation of the one blocking lever to an unblocking position such that the respective stop element can be non-destructively removed from the securing element pivots the other blocking lever in its blocking position, the pivoting actuation of the one blocking lever to an unblocking position occurring by manipulating the respective stop element that is being non-destructively removed.

6. The securing device according to claim 5, wherein one of the lock and the securing lever interact with the blocking lever for the actuation thereof within the respective locking device.

7. The securing device according to claim 5, wherein the respective blocking lever, for blocking the respective locking device in a direction of rotation, pivots out of a rest position into its blocking position, while it is pivoted out of the rest position in response to its actuation in an opposite other direction of rotation.

8. The securing device according to claim 5, wherein the power transmission element is embodied as a tensile force transmission element, in particular as a Bowden cable.

9. The securing device according to claim 2, wherein the respective locking device encompasses a release lever, which can be pivoted between an active position and a passive position and which, in its active position, blocks the lock in its unlocking position and which, while attaching the respective stop element to the respective securing element contacts the securing element and transfers the release lever from its active position into its passive position which pivots the lock into its locking position.

10. The securing device according to claim 9, wherein the respective stop element encompasses an accommodation comprising an insertion opening, the securing element is inserted through the insertion opening and reaches the accommodation when the stop element is attached to the securing element, and the release lever, in its active position, projects into the insertion opening to the extent that the release lever is actuated by the securing element and pivots out of its active position when the securing element is inserted into the accommodation.

11. A securing device for protecting individuals against falling, comprising:

two stop elements, which in each case each stop element can be attached releasably to a positionally fixed securing element and which in each case each stop element can be connected via a connecting element to the individual, who is to be secured;

wherein each stop element encompasses a locking device, which can be adjusted between an unlocking state, in which the respective stop element can be attached to the respective securing element or can be released therefrom, and a locking state, in which the respective stop element, which is attached to the respective securing element, cannot be released from the respective securing element in a non-destructive manner;

a coupling device, which is coupled to the locking devices of the two stop elements in such a manner that, in the unlocking state of the locking device of the one stop element, it blocks the locking device of the other stop element in its locking state;

wherein the coupling device encompasses a blocking lever for at least one locking device, said blocking lever being capable of being pivoted into a blocking position for blocking the respective locking device in its locking state;

wherein the respective locking device encompasses a lock, which can be pivoted between a locking position, which is assigned to the locking state of the locking device, and an unlocking position, which is assigned to the unlocking state of the locking device;

wherein the respective locking device encompasses a release lever, which can be pivoted between an active position and a passive position and which, in its active position, blocks the lock in its unlocking position and which, by attaching the respective stop element to the respective securing element transfers the release lever from its active position into its passive position which pivots the lock into its locking position; and wherein the release lever is pretensioned into its respective position by means of a pressure spring actuation which encompasses an over dead center position in the active position as well in the passive position, so that it automatically pivots against the reset force of the pressure spring actuation into its respective other position, in particular in response to overcoming the dead center position.

12. A securing device for protecting individuals against falling, comprising:

two stop elements, which in each case each stop element can be attached releasably to a positionally fixed securing element and which in each case each stop element can be connected via a connecting element to the individual, who is to be secured;

wherein each stop element encompasses a locking device, which can be adjusted between an unlocking state, in which the respective stop element can be attached to the respective securing element or can be released therefrom, and a locking state, in which the respective stop element, which is attached to the respective securing element, cannot be released from the respective securing element in a non-destructive manner;

a coupling device, which is coupled to the locking devices of the two stop elements in such a manner that, in the unlocking state of the locking device of the one stop element, it blocks the locking device of the other stop element in its locking state;

wherein the coupling device encompasses a blocking lever for at least one locking device, said blocking lever being capable of being pivoted into a blocking position for blocking the respective locking device in its locking state;

wherein the respective locking device encompasses a lock, which can be pivoted between a locking position, which is assigned to the locking state of the locking device, and an unlocking position, which is assigned to the unlocking state of the locking device wherein the respective locking device encompasses a release lever, which can be pivoted between an active position and a passive position and which, in its active position, blocks the lock in its unlocking position and which, by attaching the respective stop element to the respective securing element transfers the release lever from its active position into its passive position which pivots the lock into its locking position; and wherein the release lever, in response to pivoting from its passive position into its active position, pivots through the accommodation in such a manner that it thereby drives the securing element, when the securing element is arranged in the accommodation, out of the accommodation.

13. The securing device according to claim 2, wherein the respective lock, in its locking position, locks an insertion opening, through which the securing element must be moved out when the respective stop element is to be removed from the securing element.

14. The securing device according to claim 3, wherein the lock is embodied as a directly manually actuatable lock actuatable by direct contact by a user when attached to the securing element, the securing lever is embodied as a directly manually actuatable securing lever actuatable by direct contact by a user when attached to the securing element, and the securing lever and the lock are arranged at opposite sides of the stop element.

15. The securing device according to claim 1, wherein at least one of the stop elements encompasses only a single roller.

16. A stop element for being attached releasably to a positionally fixed securing element, the stop element being capable of being coupled to a similar second stop element by a coupling device, the stop element comprising:

a housing capable of being coupled to a securing element for releasably attaching the stop element to the securing element;

a locking device, which can be adjusted between an unlocking state, in which the stop element can be attached to the respective securing element or can be released therefrom, and a locking state, in which the stop element, when attached to the securing element, cannot be released from the securing element in a non-destructive manner;

a blocking lever cooperating with the locking device, the blocking lever being capable of being pivoted into a blocking position for operably blocking the respective locking device in its locking state such that the locking device cannot be pivoted from its locking state to its unlocking state in a non-destructive manner, the blocking lever having an unblocking position wherein the locking device can be adjusted between the unlocking state and the locking state.

17. A securing device for protecting individuals against falling, comprising:

first and second stop elements, the first and second stop elements each being releasably attachable to a positionally fixed securing element, each stop element including:

a housing defining an accommodation for receiving a securing element therein, the accommodation defining an insertion opening through which the securing element is received to attach the stop element to the securing element;

a locking device movable relative to the housing, the locking device including a lock moveably supported by the housing, the lock being movable between a locking position relative to the housing in which the lock blocks the insertion opening and an unlocking position in which the lock does not block the insertion opening;

a blocking lever movably supported by the housing, the blocking lever movable between a blocking position relative to the locking device and an unblocking position relative to the locking device, when the blocking lever is in the blocking position the lock is operably blocked in the locking position such that the lock cannot be transitioned into the unlocking position in a non-destructive manner and when the blocking lever is in the unblocking position the lock can be adjusted from the locking position to the unlocking position;

a coupling device operably coupling the first stop element to the second stop element such that when the blocking lever of the first stop element is transitioned to the unblocking position, the blocking lever of the second stop element is transitioned to the blocking position.

18. The securing device of claim 17, wherein operation of the blocking levers is independent of whether or not the first or second stop element is attached to the securing element.

19. The securing device of claim 17, wherein:

the lock is rotatably supported to the housing for rotation about a lock pivoting axis for rotational motion relative to the housing between the locking position and the unlocking position; and the lock has only a single degree of freedom relative to the housing, the single degree of freedom being rotational motion about the lock pivoting axis for motion between the locking position and unlocking position.

20. The securing device of claim 17, wherein the blocking lever of the first stop element is actuatable from the blocking position to the unblocking position by direct manual actuation of the locking device of the first stop element relative to the housing of the first stop element;

wherein actuation of the blocking lever of the first stop element from the blocking position to the unblocking position by direct manual manipulation of the locking device of the first stop element transitions the blocking lever of the second stop element into the blocking position.

21. The securing device of claim 17, wherein manipulation of the blocking lever from the blocking state to the unblocking state is entirely independent of interaction of the first and second stop elements with the securing element; and wherein manipulation of the blocking lever from the unblocking state to the blocking state is entirely independent of interaction of the first and second stop elements with the securing element.

22. The securing device of claim 21, wherein the blocking lever of the first stop element is actuatable from the blocking position to the unblocking position by direct manual actuation of the locking device of the first stop element;

wherein the actuation of the blocking lever of the first stop element from the blocking position to the unblocking position transitions the blocking lever of the second stop element into the blocking position via the coupling.

23. The securing device of claim 17, wherein the blocking lever of each stop element does not directly contact the lock of the corresponding stop element.

24. The securing device of claim 23, wherein the first and second stop elements each include a securing lever operably mechanically interposed between the corresponding blocking lever and lock, wherein the blocking lever blocks the lock in its locking position by blocking the securing lever in a securing position, in which the securing lever prevents the lock from transitioning from the locking position to the unlocking position in a non-destructible manner.

25. The securing device of claim 1, wherein the locking device of each stop element is directly manually actuatable, by direct contact by a user, from the locking state to the unlocking state, wherein the direct manual actuation of the locking device of one of the stop element transitions the blocking lever of the other one of the stop elements to the blocking position.

* * * * *